US005250993A

United States Patent [19]

Seyfried et al.

[11] Patent Number: 5,250,993

[45] Date of Patent: Oct. 5, 1993

[54] CONNECTION BETWEEN MOVABLE DEVELOPER UNIT AND STATIONARY TONER RESERVOIR

[75] Inventors: Joseph A. Seyfried; L. James Rolph, both of Webster; Kirk A. Blakesley, Newark, all of N.Y.

[73] Assignee: Xerox Corporation, Stamford, Conn.

[21] Appl. No.: 755,419

[22] Filed: Sep. 5, 1991

[51] Int. Cl.[5] ..... G03G 15/06

[52] U.S. Cl. ..... 355/245; 355/260

[58] Field of Search ..... 355/245, 246, 260, 326; 222/DIG. 1; 141/363, 364

[56] References Cited

U.S. PATENT DOCUMENTS

| | | | |
|---|---|---|---|
| 4,740,767 | 4/1988 | Kawano et al. | 355/260 |
| 4,878,091 | 10/1989 | Morita et al. | 355/326 X |
| 4,942,432 | 7/1990 | Mort et al. | 355/260 |
| 4,963,936 | 10/1990 | Carter | 355/245 |
| 4,997,016 | 3/1991 | Hacknauer et al. | 322/DIG. 1 X |
| 5,040,024 | 8/1991 | Fukuda et al. | 355/260 |

*Primary Examiner*—A. T. Grimley
*Assistant Examiner*—Shuk Y. Lee
*Attorney, Agent, or Firm*—Kenyon & Kenyon

[57] ABSTRACT

An apparatus for supplying toner material to a developer unit of an electrophotographic system that is mounted within a drawer and pivotable within the drawer about a longitudinal pivot axis between an active position and a non-active position includes a pivot stack connected to the developer unit at its lower end, pivoting within the developer unit about the pivot axis, said pivot stack, and having a toner passage therethrough. The apparatus also includes means for retaining the upper end of the pivot stack in a position fixed with respect to the pivot axis and means for sealing the lower end of the toner stack to the developer unit to prevent leakage of toner. The apparatus can also include a mount fixed with respect to a chassis of the system and connected to the outlet end of a toner conduit coupled to the toner reservoir, means for releasably engaging the upper end of the pivot stack that is supported on the mount for limited movement perpendicular to the longitudinal axis, and a first passage connecting the outlet end of the conduit and having an outlet end with the pivot stack when the developer unit is in the operative position, and means for sealing the outlet end of the first passage when the developer unit is in the service position.

8 Claims, 10 Drawing Sheets

CONNECTION BETWEEN MOVABLE DEVELOPER UNIT AND STATIONARY TONER RESERVOIR

BACKGROUND OF THE INVENTION

The invention relates generally to a color electronic reprographic printing system, and more particularly concerns an apparatus for controlling the movement of a sheet to which is applied a plurality of developed images transferred thereto and the movement of a sheet gripper to prevent the image-bearing surface of the sheet from touching stationary surfaces in the printing system while the sheet is moving in a recirculating path.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal to the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

Toner is applied to the photoconductive member by a developer unit that contains a relatively small quantity of toner material mixed with magnetic carrier particles. The supply of toner material in the developer unit is diminished during application of toner images to the photoconductive member and must be replenished. Typically, a toner reservoir is attached directly to the developer unit. This direct attachment minimizes cost and problems with conducting toner material from a remote reservoir. The reservoir itself is typically refilled or replaced by the user. In color electrophotographic systems, four toner reservoirs and four developer units are required. Since limited space available in the printing machine dictates that multiple toner reservoirs attached directly to developer units be small, requiring frequent refill or replacement of the toner reservoirs, remote reservoir placement is particularly desirable.

One particular problem with remote reservoir placement is providing for an interface between the toner reservoirs and the developer units. Developer units are typically mounted in a drawer that is slidable relative to the chassis of the electrophotographic system between an operative position and a service position for access by the user or service personnel. However, remote toner reservoirs are mounted in the chassis of the system in a location readily accessible by the user for replenishment. Thus, a connection is required between the movable developer units and the stationary toner reservoirs. To prevent both loss of toner and contamination of the system's interior with toner, this connection must reliably close off the outlets from the toner reservoirs when the developer units are moved away from the reservoirs and must provide for clean re-engagement with the developer unit. However, in complex moving assemblies such as the sliding drawer with the attached developer units, small dimensional variations in component parts can stack up to relatively large quantities across the interface between the stationary toner reservoir and the sliding developer unit. This makes a reliable and clean connection difficult to achieve.

In color electrophotographic systems, each of the multiple toner image is transferred by a corresponding developer unit. The developer unit transferring an image is in an active position in close proximity with the photoconductive member, while the remaining units are displaced away from the photoconductive member in non-active positions. The developer units are thus movable between active and non-active positions within the slidable drawer. The interface of a stationary toner reservoir with a corresponding developer unit is complicated by the movement of the developer units between the active and non-active positions. Further, it is desirable that the developer unit be supplied with toner material in both its active and non-active positions because this allows slower toner input, which enhances mixing of newly-added toner with the developer material already in the developer unit.

There is thus a need for an interface between a stationary toner reservoir and a developer unit movable in two senses—between active and non-active positions relative to the photoconductive member and between operative and service positions relative to the system chassis.

SUMMARY OF THE INVENTION

This need is met by the apparatus of the invention. In one embodiment, the apparatus supplies toner material to a developer unit of an electrophotographic system that is mounted within a drawer and pivotable within the drawer about a longitudinal pivot axis between an active position and a non-active position, and includes a pivot stack connected to the developer unit at its lower end, pivoting within the developer unit about the pivot axis, said pivot stack, and having a toner passage therethrough. The apparatus also includes means for retaining the upper end of the pivot stack in a position fixed with respect to the pivot axis and means for sealing the lower end of the toner stack to the developer unit to prevent leakage of toner.

In another embodiment, the apparatus also includes a mount fixed with respect to a chassis of the system and connected to the outlet end of a toner conduit coupled to the toner reservoir, means for releasably engaging the upper end of the pivot stack that is supported on the mount for limited movement perpendicular to the longitudinal axis, and a first passage connecting the outlet end of the conduit and having an outlet end with the pivot stack when the developer unit is in the operative position, and means for sealing the outlet end of the first passage when the developer unit is in the service position.

DETAILED DESCRIPTION

Figure 1:
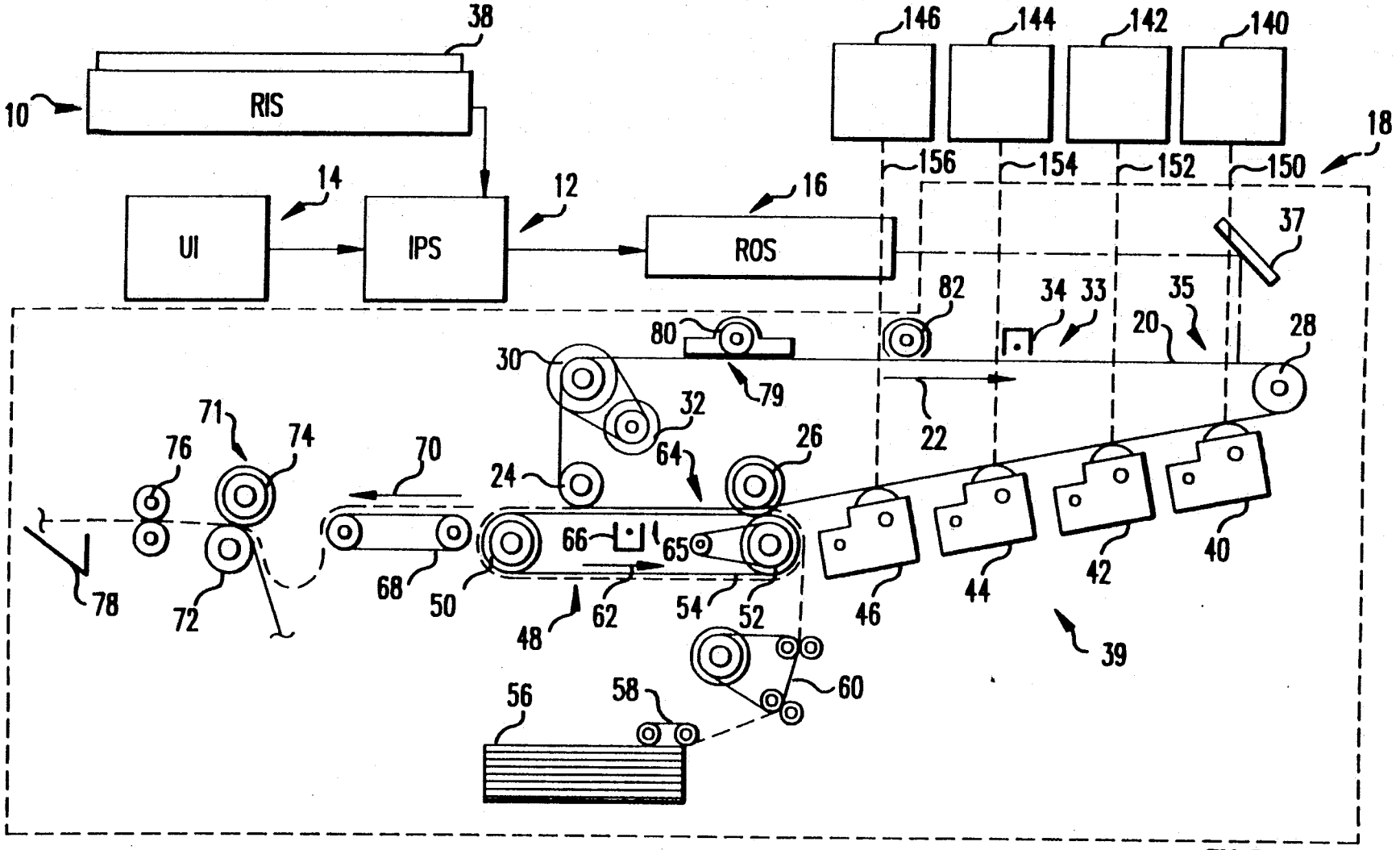
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD) array. The RIS captures the entire original document and converts it to a series of raster scan lines and measures a set of primary color densities, i.e. red, green, and blue densities, at each point of the original document. This information is transmitted to an image processing system (IPS), indicated generally by the reference numeral 12. IPS 12 contains control electronics that prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser and an associated rotating polygon mirror block. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines, which are transmitted as electrical signals to IPS 12. The electrical signals from RIS 10 correspond to the red, green, and blue densities at each point in the original document. IPS 12 converts the set of red, green, and blue density signals, i.e., the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color which corresponds to the complement of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44, and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

Developer units 40, 42, 44, and 46 are supplied with toner particles from corresponding toner dispensers 140, 142, 144, and 146, respectively, via toner supply conduits 150, 152, 154, and 156, respectively.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper or transparent plastic. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper extends between belts 54 and moves in unison therewith.

A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper.

As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another.

One skilled in the art will appreciate that the sheet may move in a recirculating path for four cycles when under color black removal is used and up to eight cycles when the information on two original documents latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
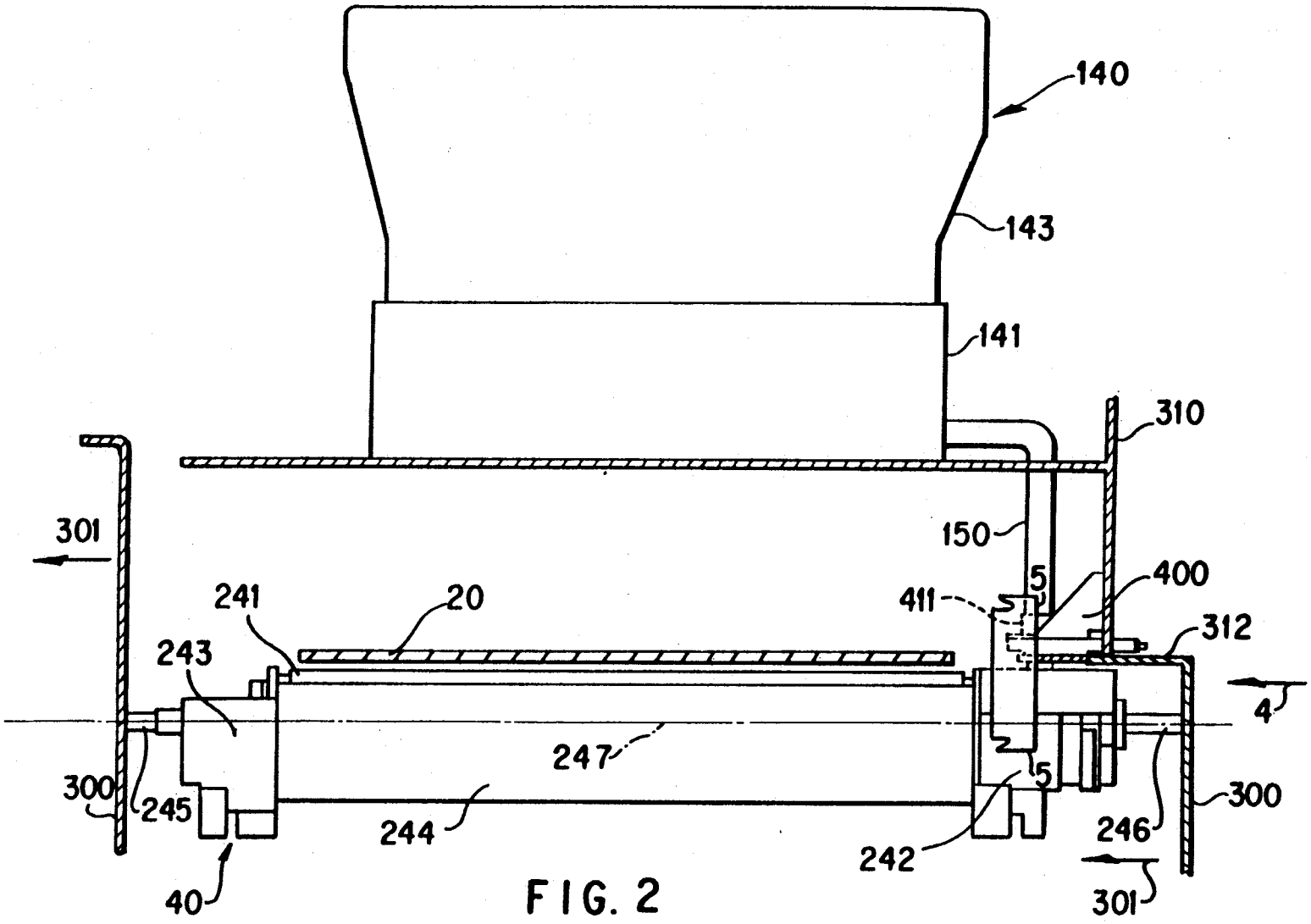
FIG. 2 is a schematic elevational view illustrating the toner dispenser, developer unit, and dispenser conduit used in the printing machine of FIG. 1.

FIG. 2 shows a schematic elevational view of a toner dispenser 140, toner conduit 150, and developer unit 40 used in the machine illustrated in FIG. 1. The following description of these elements applies equally to the other three toner dispensers, toner conduits, and developer units.

Developer unit 40' has an applicator roll 241 that carries the brush of developer material, rotatably supported between a rear housing 242 and a front housing 243. The front and rear housing define with a main housing 244 a chamber holding developer material in contact with the applicator roll 241. Developer unit 240 is pivotally supported on front and rear pivot pins 245 and 246, respectively, about a longitudinal pivot axis 247. Pivot pins 245 and 246 are mounted to a drawer 300 that is slidably mounted within the printing machine 18 for motion between a closed position (shown) and an open position (not shown) along the longitudinal direction indicated by arrows 301 relative to the fixed chassis 310 of the printing machine. The developer unit is pivotable about pivot axis 247 between a non-operative position (shown) in which the applicator roll 241 is spaced from photoreceptor belt 20 and an operative position (not shown) in which the applicator roll is adjacent to the photoreceptor belt.

Toner dispenser 140 has a fixed portion 141 mounted to the chassis 310 of the printing machine 18 and a replaceable portion 143 that is releasably attached to the fixed portion 141. The fixed and replaceable portions together form a reservoir that contains a relatively large quantity of toner. Toner conduit 150 is connected at its upper end to fixed portion 141 and conducts toner from the fixed portion to the developer unit. The toner conduit is coupled to the developer unit by disconnect assembly 400, which is mounted to the chassis 310.

Figure 3:
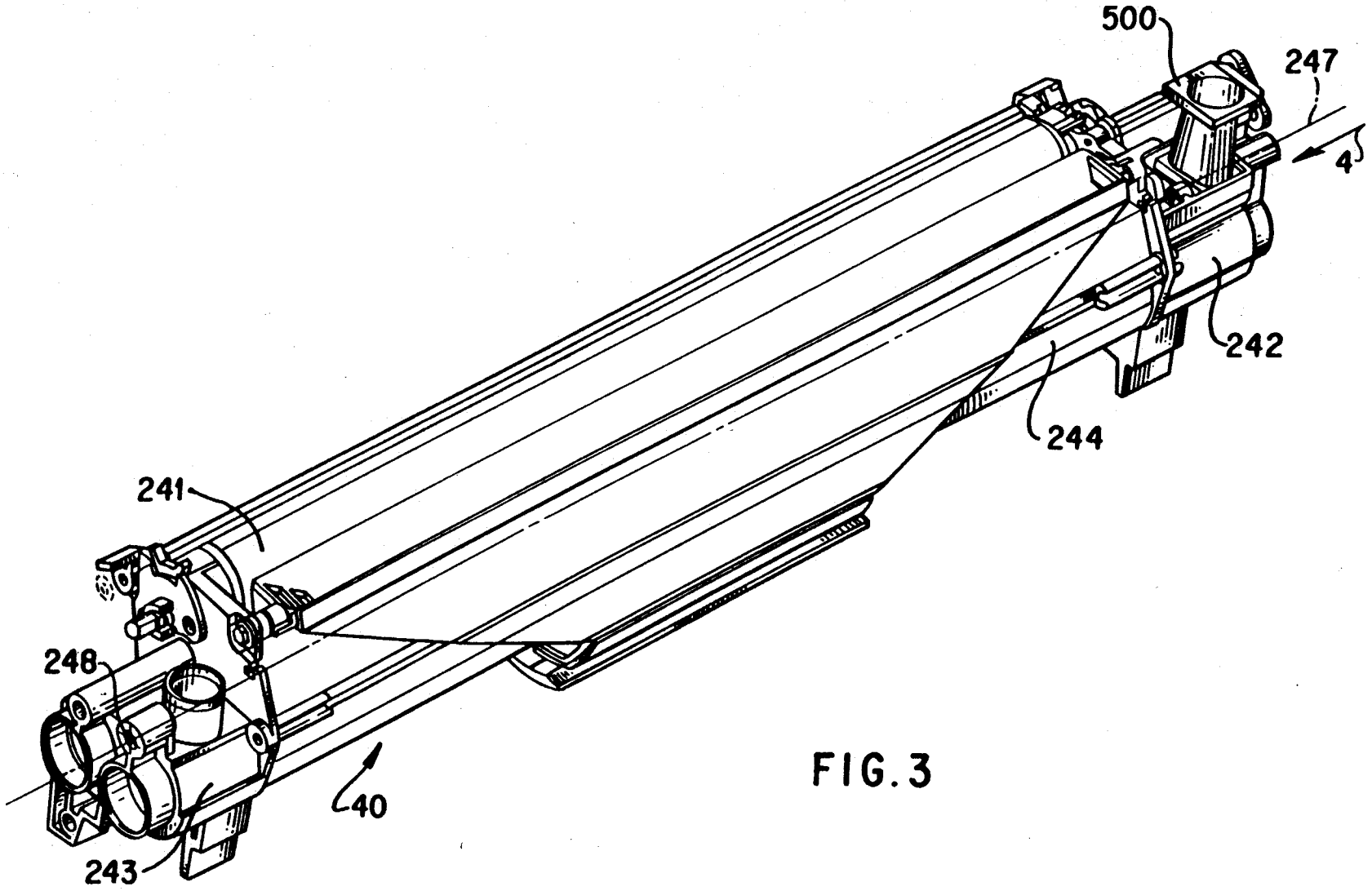
FIG. 3 is a perspective view showing the developer unit shown in FIGS. 1 and 2.

The developer unit 40 is further illustrated in an isometric view in FIG. 3. Pivot axis 247 passes through front pivot pin mount 248, which engages front pivot pin 245 to pivotally support the forward end of the developer unit. The developer unit is coupled to the disconnect assembly 400 via pivot stack 500.

Figure 4:
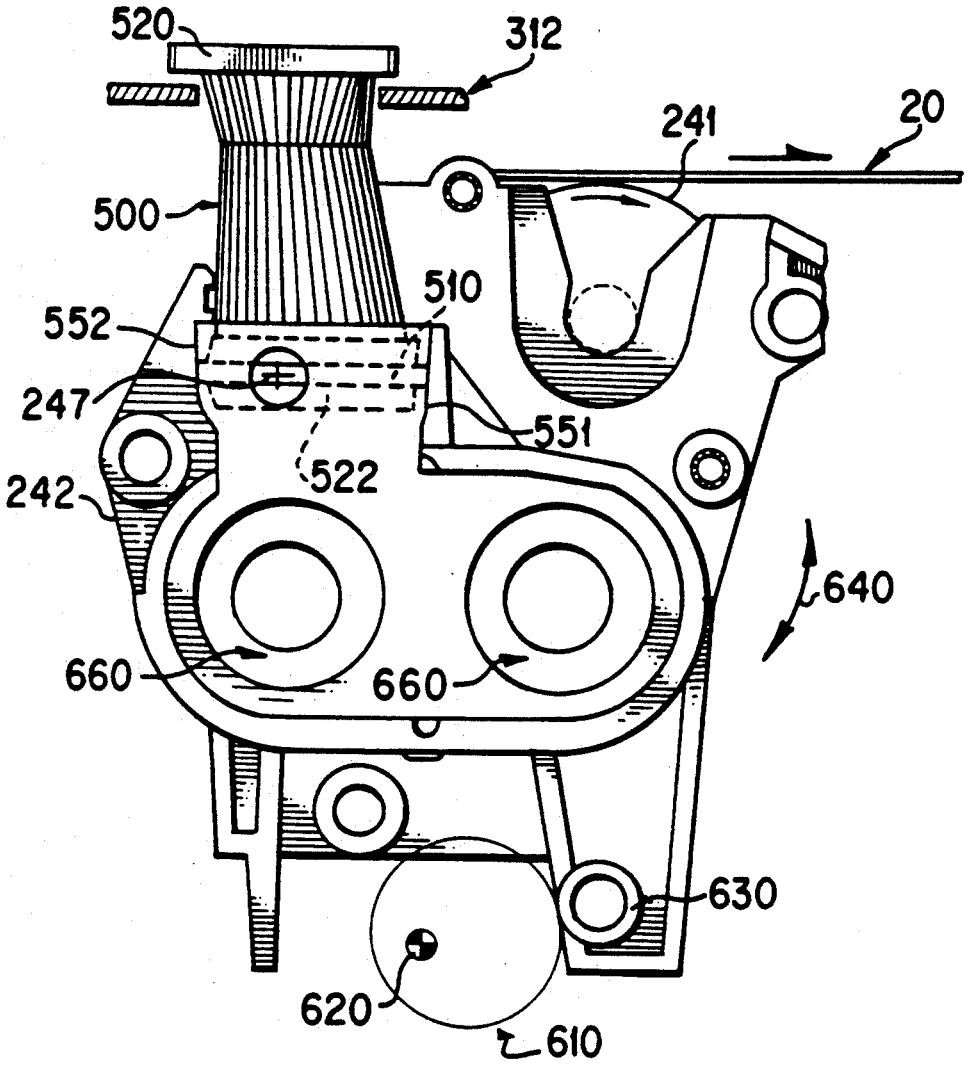
FIG. 4 is a partial cross sectional view of the developer unit shown in FIG. 3.

Pivot stack 500 and its connection to developer unit 40 are illustrated in FIGS. 4–8. FIG. 4 is a partial cross-sectional view of the pivot stack, rear developer housing, and disconnect assembly shown in FIGS. 2 and 3, taken in the direction indicated by arrow 4. A cam 610 rotates about an axis 620 to engage cam follower 630 and pivot the developer unit about pivot axis 247, as indicated by double arrow 640. The developer unit is shown in FIG. 4 in its operative position, with the applicator roll 241 adjacent to photoreceptor belt 20. A pair of augers 660 circulate developer material within the main housing 244.

The upper end of pivot stack 500 is engaged below upper stack flange 520 by a cover 312 connected to the drawer 300. The cover 312 maintains the upper end of the pivot stack in approximately a fixed relationship to the drawer 300. The pivot stack also pivots about axis 247. Thus, when the cam is rotated, pivoting the developer unit about axis 247 relative to the drawer 300, the pivot stack pivots about axis 247 to maintain its lower end in connection with the rear developer housing and its upper end in a fixed position relative to the drawer. Upper stack flange 520 has an upper, sealing surface 521 a lower surface 523, and a bearing surface 527.

Pivot stack 500 is engaged at its lower end in stack pocket 550 of rear developer housing 242. Front pivot shaft 542 is rotatably engaged in front stack mount 543, while rear pivot shaft 544 is rotatably engaged in rear stack mount 544. Rear pivot pin 246 (FIG. 2) is rotatably engaged in rear pivot pin mount 249.

Figure 6:
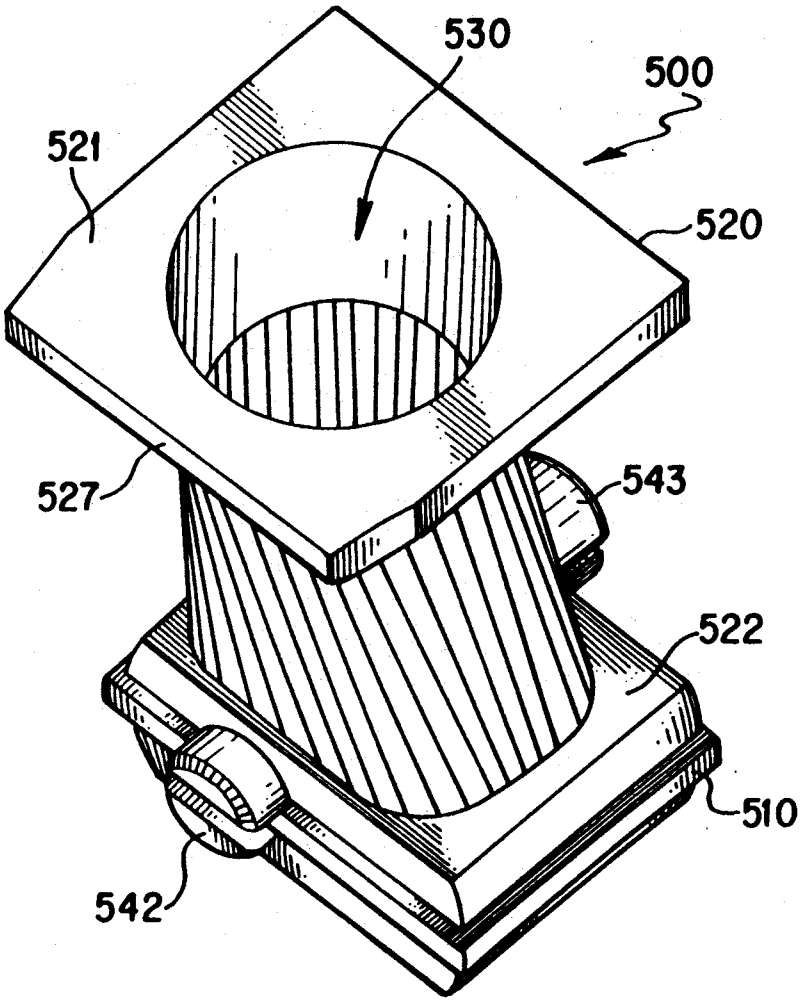
FIGS. 5 and 6 are isometric views of the pivot stack shown in FIG. 4.
Figure 5:
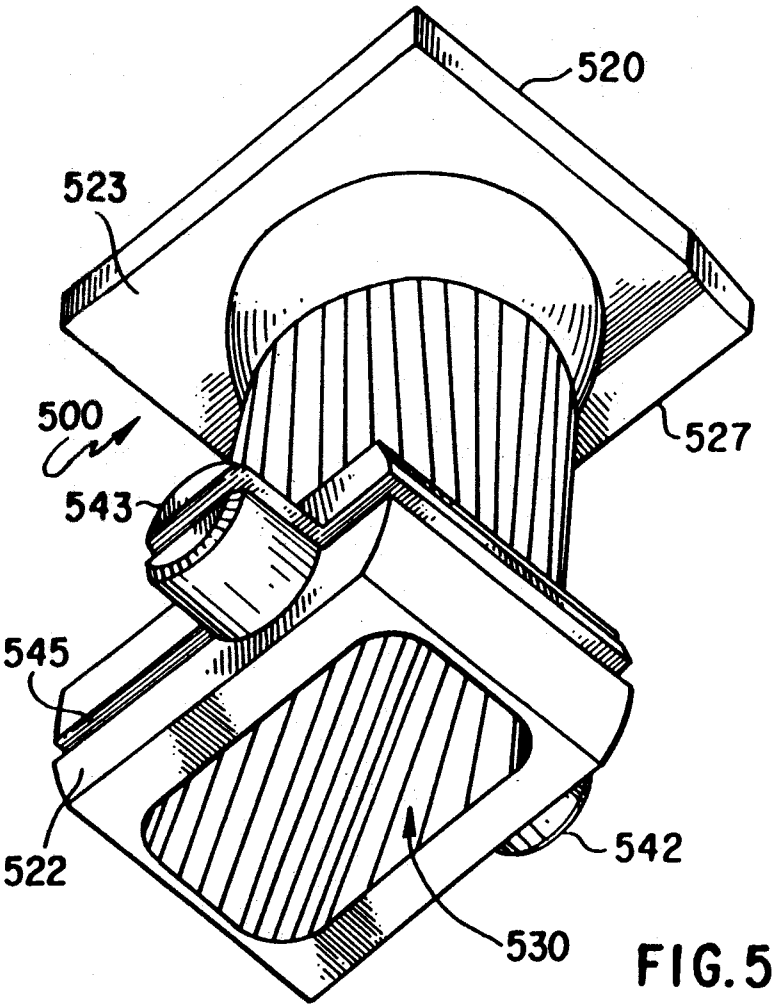
Figure 8:
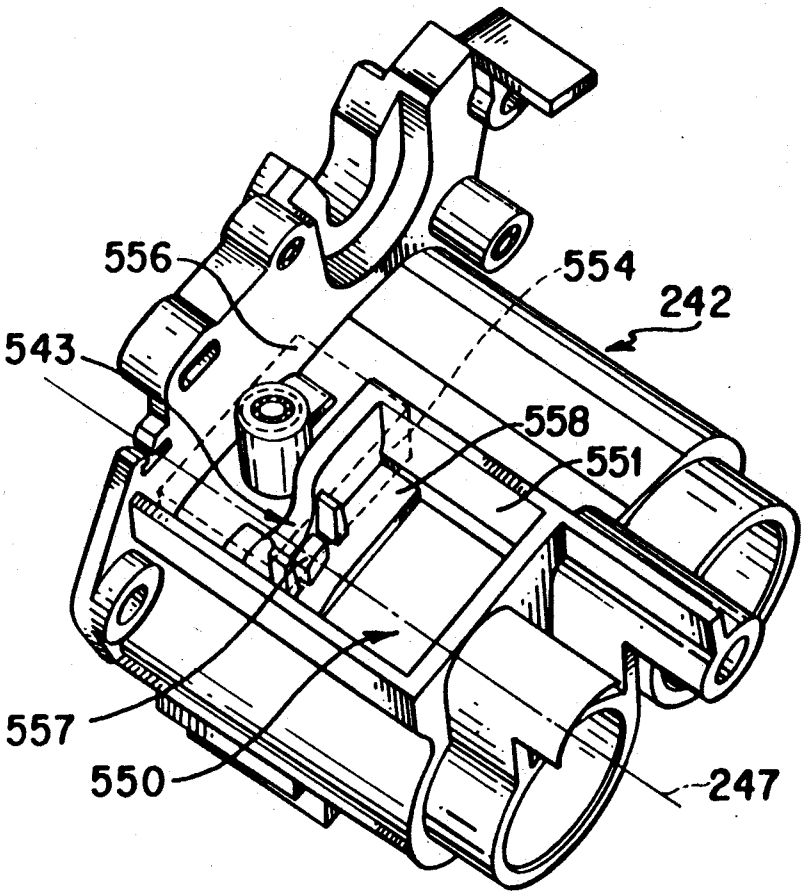
FIGS. 7 to 9 are isometric views of the rear developer housing shown in FIGS. 3 and 4.
Figure 7:
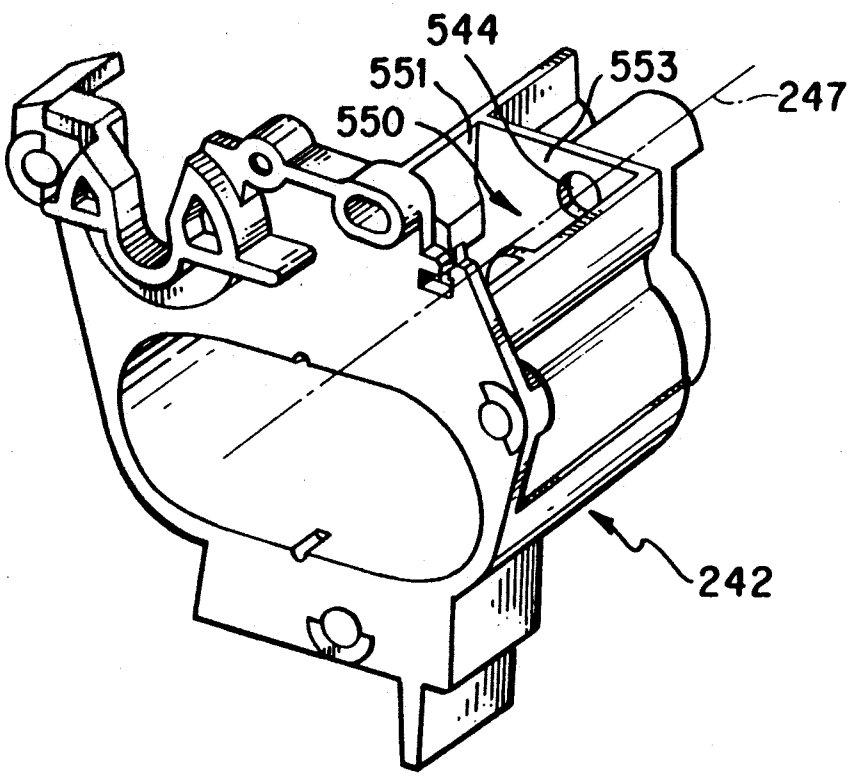
Figure 9:
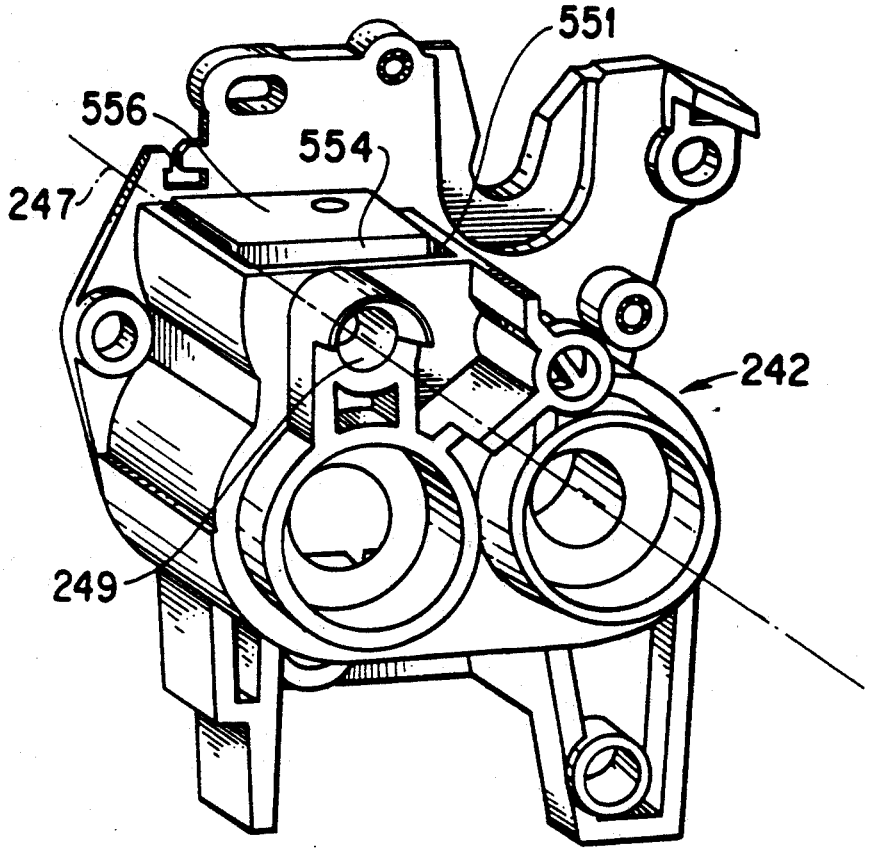
Figure 10:
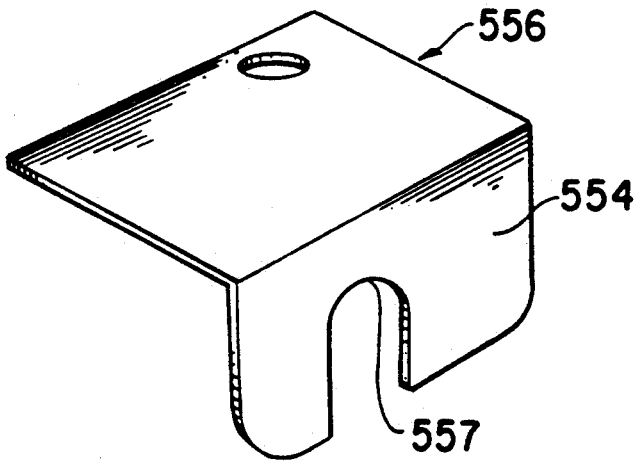
FIG. 10 is an isometric view of the stack retainer shown in FIGS. 8 and 9.

Pivot stack 500 has a central passage 530 through which toner material is conducted from conduit 150 to rear developer housing 242. The front and rear pivot shafts project from lower flange 522. Lower flange 522 is formed with a peripheral channel 545 (FIG. 5) into which is fitted a resilient rectangular stack seal 510 (FIGS. 4, 6). Stack seal 510 slidingly sealingly engages at its perimeter three surfaces in the rear developer housing 244: a) left sealing surface 551; b) right sealing surface 552; and c) rear sealing surface 553. The stack seal also engages at its front end vertical sealing surface 554 of stack retainer 556. Stack retainer 556, illustrated in FIG. 10, and shown in solid lines in FIG. 9 and dashed lines in FIG. 8, also has a semi-circular, concave-downward front pivot pin retaining surface 557. The front pivot pin is thus trapped between front stack mount 543 and retaining surface 557. The side and bottom perimeter of sealing surface 554 sealingly engages left sealing surface 551, right sealing surface 552, and bottom sealing surface 558 of rear developer housing 242. Thus toner and developer material contained in the rear developer housing cannot leak from between pivot stack 500 and the rear developer housing.

Pivot stack 500 and rear developer housing 242 are preferable molded from polycarbonate (for dimensional stability and toner/developer compatibility) with 10% glass (for strength) and 15% polytetrafluoroethylene (for lubricity), such as the material sold under the trade name DFL 4032 by LNP. Stack seal 510 is preferably formed of cellular urethan, such as the material sold under the trade name Poron by Rogers Corporation by identification number 4701-59-20093-1648. Since the seal has a wiping action, a closed cell foam is preferred for its stiffness, density, and low coefficient of friction with the polycarbonate of the rear developer housing. Stack retainer 556 can be formed of any suitable material, such as sheet aluminum.

Figure 11:
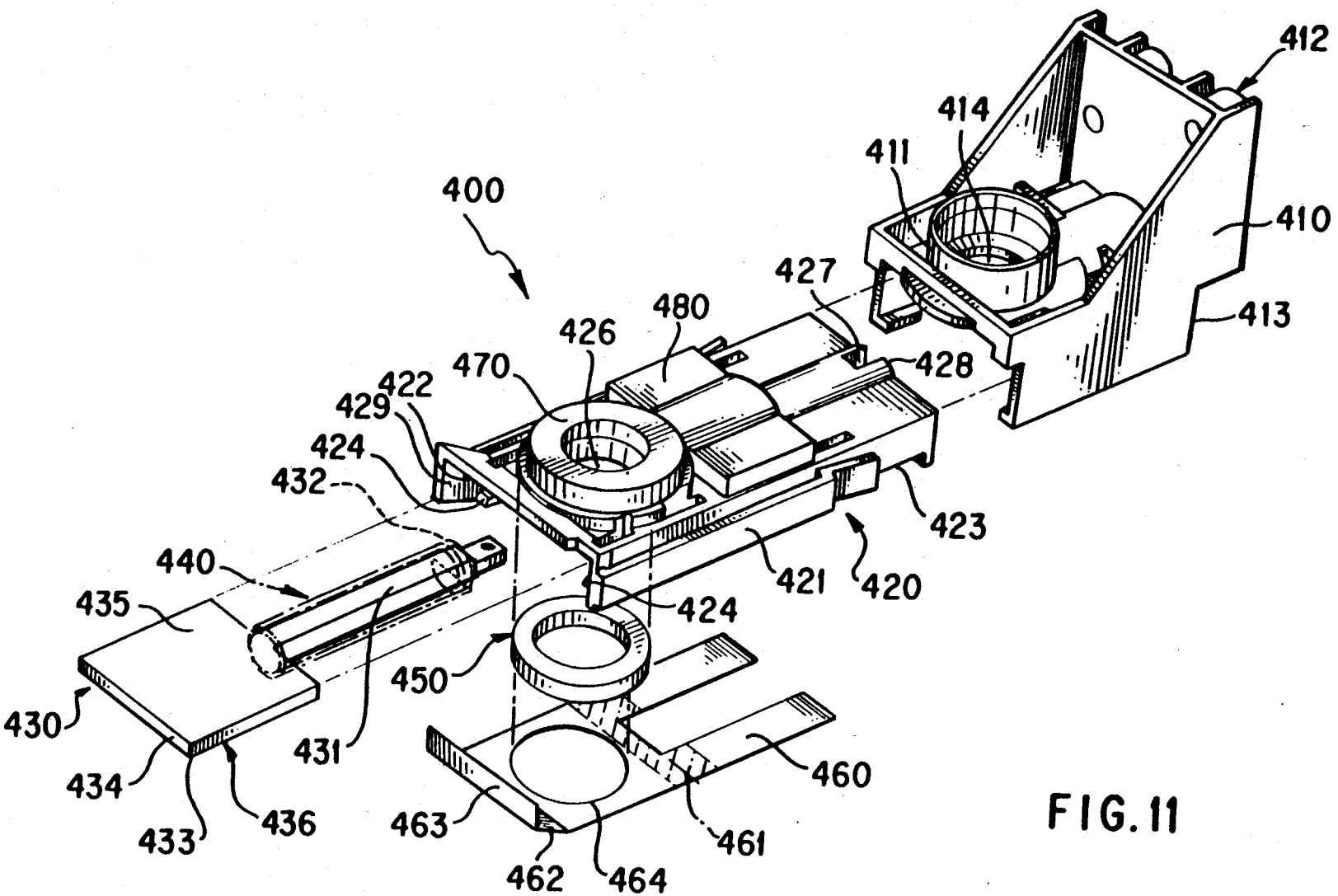
FIG. 11 is an exploded isometric view of the disconnect assembly shown in FIG. 2.
Figure 12:
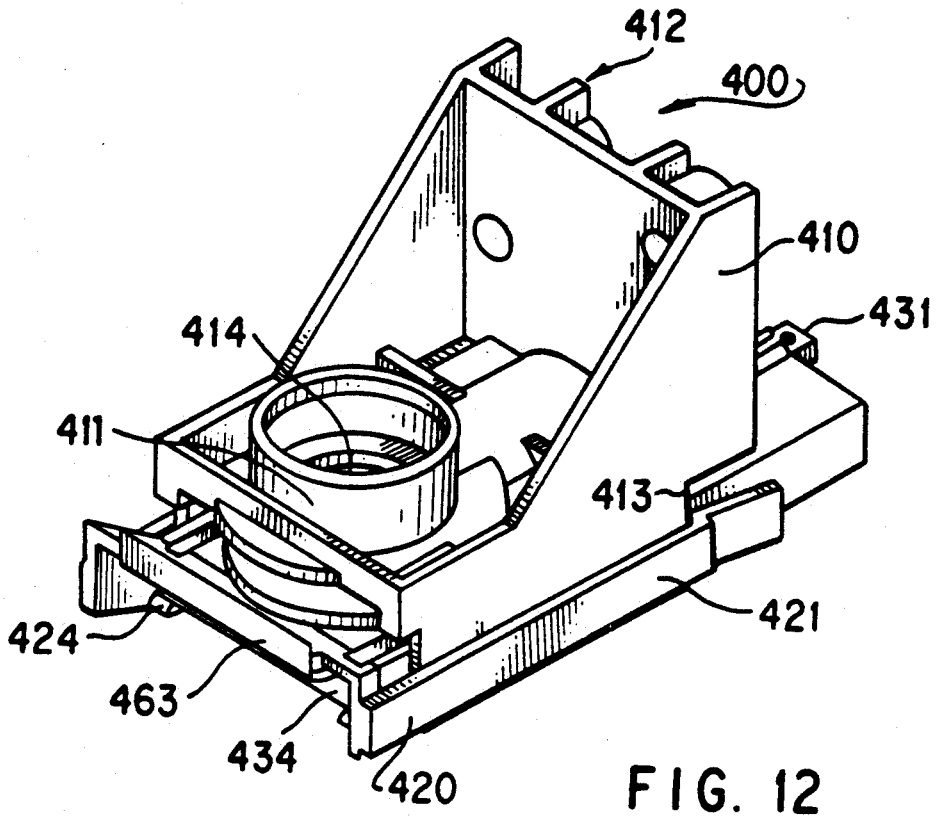
FIG. 12 is an isometric view of the disconnect assembly shown in FIGS. 2 and 11.
Figure 13:
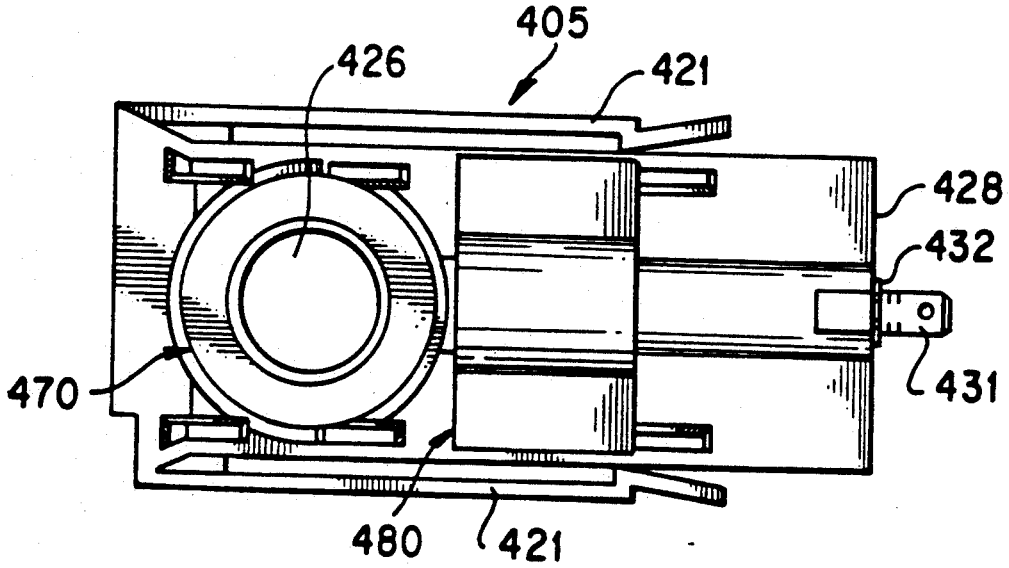
FIG. 13 is a plan view of the slide assembly of the disconnect assembly shown in FIGS. 2, 11, and 12.

Disconnect assembly 400 is illustrated in FIGS. 11–13. Slide support 410 is fixedly mounted at its rear end 412 to the printer chassis 310. Cylindrical connector 411 couples to the lower end of conduit 150, as shown in FIG. 2. Slide support 410 has a circular opening 414 therethrough that is coaxially aligned with connector 411.

Slide assembly 405 is releasably engaged in slide support 410. The slide assembly includes slide housing 420, slide 430, annular seal 450, annular cushion 470, sheet seal 460, and rear cushion 480. Latching arms 421 engage shoulder 413 of the slide support 410 to retain the slide assembly within the slide support in a longitudinal direction. Cushions 470 and 480 and annular seal 450 are formed of a resilient foam such as a non-reticulated flexible polyurethane, polyether type cellular foam. The cushions are fixed to the slide housing by any suitable means, such as adhesive. When the slide assembly is engaged in slide support 410, the cushions are slightly compressed, yieldably urging the slide assembly downwardly, away from the slide support. The lower edge 423 of slide housing 420 engages lip 414 on the slide support to limit the downward travel of the slide assembly. Slide housing 420 has a circular opening 426 therethrough. Cushion 470 is coaxially aligned with opening 426. When slide housing 420 is assembled with slide support 410, opening 426 is aligned coaxially with opening 414, so that toner material entering the upper end of cylindrical connector 411 from conduit 150 can pass through the openings 414 and 426.

Annular seal 450 is disposed within an annular channel formed in the underside of the slide assembly about opening 426 so that it protrudes slightly below the surface of the underside of the slide assembly. Sheet seal 460, preferably formed of mylar for low friction, is fixed to the underside of the slide assembly below the annular seal by suitable means such as an adhesive bond in the hatched area 461. The sheet seal is formed with an upwardly and forwardly sloping portion 462 and a vertical portion 463, and has a circular opening 464 that is aligned coaxially with opening 426, cushion 470, and annular seal 450. Slide housing 420 has side guide surfaces 429 that angle inwardly from the front edge of the housing and upper guide surface 422 that angles downwardly from the front edge. The portion 462 of sheet seal 460 is disposed adjacent upper guide surface 422, while vertical portion 463 is disposed adjacent the front edge of the slide housing.

Slide 430 is slidably mounted within slide housing 420. It has a flat sealing portion 433 and an arm 431 projecting rearwardly from the rear of the sealing portion. Sealing portion 433 has an upper, sealing surface 435, a lower surface 433, and a front edge 434. Slide 430 is disposed within the slide housing 420 between the flat seal 460 guide rails 424. Annular seal 450 yieldably urges slide 430 downwardly against the guide rails and urges sheet seal 460 into sliding, sealing contact with upper, sealing surface 435 of slide 430.

Slide 430 is biased toward the front of slide housing 420 by compression spring 440, which is disposed concentrically about arm 431 and abuts at its forward end the rear edge of sealing portion 433 and its rearward end against shoulder 427 on the forward face of the rearward end of slide housing 420. Forward movement of slide 430 is limited by e-ring 432 fixed in a slot formed in the rear end of arm 431, which abuts against the rearward surface 428 of the rearward end of slide housing 420. Slide 430 can thus slide between a first, sealing position and a second, open position. In the sealing position, the sealing portion 435 is in sealing contact with the lower face of sheet seal 460 about the perimeter of opening 464, thus preventing leakage of any toner material from conduit 150 through opening 464. In the open position, the front edge 434 of slide 430 is disposed to the rear of opening 464, thus permitting free passage of toner material from conduit 150 into cylindrical connector 411, through opening 414, cushion 470, opening 460, annular seal 450, and opening 464.

Figure 14:
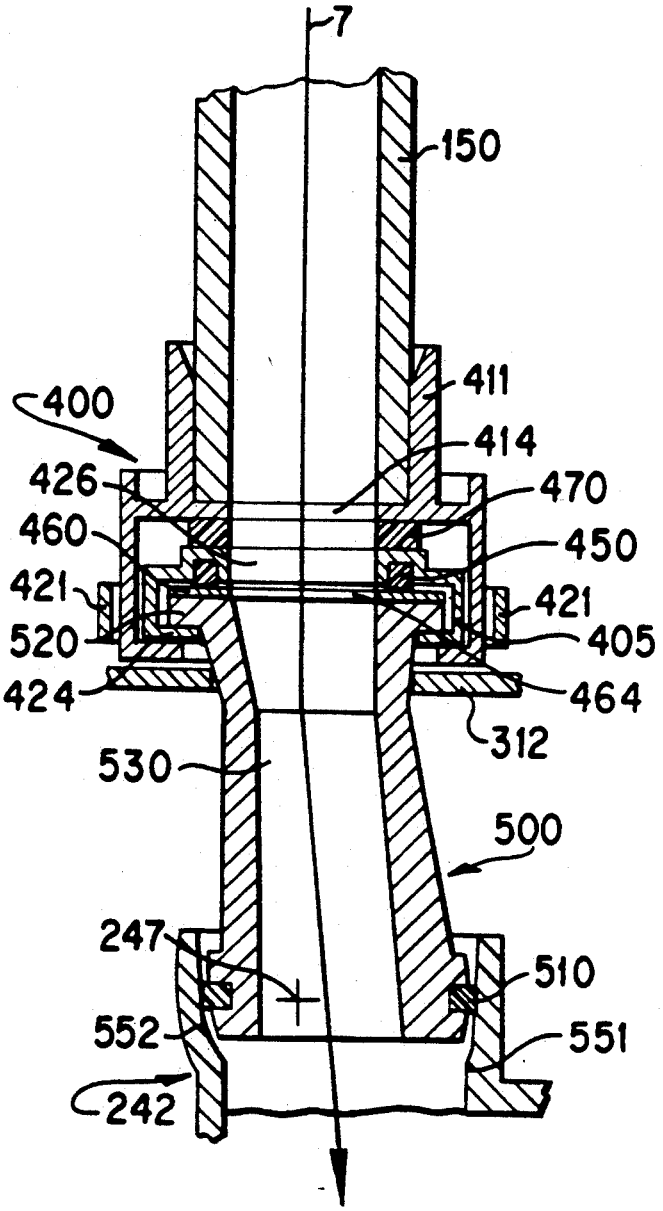
FIG. 14 is a partial cross-sectional view of the disconnect assembly, pivot stack, and rear developer housing along the section line 5—5 in FIG. 2.

FIG. 14 is a partial cross-sectional view of the disconnect assembly, pivot stack, and rear developer housing along the section line 5—5 in FIG. 2. In the illustrated position, the drawer 300 is in its closed, or rearward, position, in which position the flange 520 of the pivot stack is engaged in the slide housing 420, with the annular seal 450 urging the sheet seal 460 into sealing contact with the upper, sealing surface 521 of upper flange 520 of the pivot stack, and urging the slide assembly upwardly so that the lower surface 523 of the upper flange into contact with the upper surface of guide rails 424. Toner material can thus pass from the toner dispenser to the developer housing via the path indicated by arrow 7, i.e., through conduit 150 into cylindrical connector 411, through opening 414, cushion 470, opening 460, annular seal 450, opening 464, and central passage 530. The bearing surface 523 of upper stack flange 520 bears against front edge 434 of slide 430, urging the slide to its rearward position against the force of compression spring 440.

When drawer 300 is slid in the direction indicated by arrow 301, i.e., parallel to axis 247 (FIG. 2), the rear developer housing 242, bracket 312, and pivot stack 500 are carried with it. Upper flange 520 of the pivot stack slides along guide rails 424 while sealing surface 521 slides in sealing contact with the lower surface of sheet seal 460. Slide 430 slides along behind the pivot stack, with the front edge 434 of the slide maintaining contact with bearing surface 527 of upper flange 520. When the rearward edge of opening 530 clears the forward edge of opening 464, the path for toner material is interrupted. When the bearing surface 527 of upper flange 520 clears the forward edge of opening 464, slide 430 fully covers opening 464, thus sealing the opening and preventing leakage of toner material while the drawer 300 is open.

The reverse sequence occurs when drawer 300 is slid back into its rest, or operating, position. First, upper stack flange 520 enters slide housing 420. If some misalignment exists between the upper stack flange and the slide housing, the slide housing adjusts its position to accommodate the flange. If there is a side-to-side misalignment, one side of the upper flange will bear against the corresponding side guide surface 429 of the slide housing, urging the slide housing into alignment. Similarly, if there is a vertical misalignment, the bearing surface 527 of the upper flange will bear against the upper guide surface 422 of the slide housing or the tapered front edges of the guide rails to urge the slide housing into alignment against the compressive resistance of resilient cushions 470 and 480.

Once the slide housing has adjusted its position to accommodate the upper flange of the pivot stack, continued rearward movement of the drawer causes the upper flange to slide rearwardly in the slide housing. The bearing surface 527 of the upper flange contacts front edge 434 of the slide, urging it rearwardly against the compression spring 440. The slide then slides clear of opening 464 and the opening 530 slides into alignment with opening 464, reestablishing a path for toner material from the toner reservoir to the developer housing.

While the invention has been described with reference to a specific embodiment, it will be apparent to those skilled in the art that many alternatives, modifications, and variations may be made. Accordingly, it is intended to embrace all such alternatives, modifications that may fall within the spirit and scope of the appended claims.

What is claimed is:

1. An apparatus for supplying toner material to a developer unit of an electrophotographic system, the developer unit being mounted within a drawer and being pivotable within the drawer about a longitudinal pivot axis of the developer unit between an active position and a non-active position, said apparatus comprising:

a. a pivot stack having an upper end and a lower end and being connected to the developer unit at said lower end for pivoting within the developer unit about the developer unit pivot axis, said pivot stack having a first toner passage therethrough;

b. means for retaining said upper end of said pivot stack in a position fixed with respect to the pivot axis; and c. means for sealing said lower end of said pivot stack to said developer unit to prevent leakage of toner therebetween.

2. The apparatus of claim 1 further comprising:

a. a pivot shaft connected to said lower end of said pivot stack and coaxial with the developer unit pivot axis; and b. a stack pocket formed on the developer unit, said stack pocket having a second passage therethrough communicating with said first toner passage and having a stack mount coaxial with the developer unit pivot axis to support the pivot shaft for rotation.

3. The apparatus of claim 2 wherein said sealing means comprises:

a. a seal bearing surface disposed at the periphery of said stack pocket b. a resilient seal fixed to the periphery of said lower end of said pivot stack and being in sealing contact with said seal bearing surface.

4. The apparatus of claim 1 wherein said retaining means comprises a cover mounted to the drawer and engaging a portion of said upper end of said pivot stack.

5. An apparatus for selectively supplying toner material from the outlet end of a conduit connected to the outlet of a toner reservoir to a developer unit of an electrophotographic system, the developer unit being mounted within a drawer slidable with respect to a chassis along a longitudinal axis between a rear, operative position and a front, service position, the developer unit having a toner inlet, said apparatus comprising:

a. a mount fixed with respect to the chassis and connected to the outlet end of the conduit;

b. means for releasably engaging the toner inlet of the developer unit, said engaging means being supported on said mount for limited movement perpendicular to the longitudinal axis, said engaging means engaging the toner inlet when the developer unit is in the operative position, said engaging means comprising:

i. a slide housing;

ii. guide rails disposed on the lower side of the slide housing generally parallel to the longitudinal axis, said guide rails slidably guiding the toner inlet when the developer unit is near the operative position; and iii. a resilient cushion fixed to the upper side of the slide housing, said resilient cushion engaging said mount and urging said slide housing downwardly away from said mount;

c. a first passage coupled to said engaging means, said first passage includes an opening through said slide housing and said resilient cushion, said first passage also having an inlet end communicating with the outlet end of the conduit and having an outlet end, said outlet end of said first passage being in communication with the toner inlet when the developer unit is in the operative position; and d. means for sealing said outlet end of said first passage when the developer unit is in the service position.

6. The apparatus of claim 5 wherein said sealing means comprises:

a. a slide member disposed within said slide housing for slidable movement along said guide rails between a first, non-sealing position and a second, sealing position, said slide member having an upper, sealing surface that sealingly engages said outlet end of said first passage when the developer unit is in the service position;

b. means for yieldably urging said slide member toward said sealing position, said slide member being displaced by the toner inlet from said sealing position to said non-sealing position when the developer unit is in the operative position.

7. The apparatus of claim 6, further comprising:

a. a generally flat sheet seal fixed to said slide housing and disposed between said slide housing and said slide member, said sheet seal having a low coefficient of friction with said slide member and having an opening therethrough; and b. a second resilient cushion disposed between said slide housing and said sheet seal and resilient urging said sheet seal downwardly, said second resilient cushion having an opening therethrough communicating with said opening of said sheet seal, said sheet seal opening and said second resilient cushion opening forming said outlet end of said first passage.

8. An apparatus for selectively supplying toner material from the outlet end of a conduit connected to the outlet of a toner reservoir to a developer unit of an electrophotographic system, the developer unit being mounted within a drawer slidable with respect to a chassis along a longitudinal sliding axis between a rear, operative position and a front, service position, the developer unit being pivotable within the drawer about a pivot axis of the developer unit between an active position and a non-active position, said apparatus comprising:

a. a pivot stack having an upper end and a lower end and being connected to the developer unit at said lower end for pivoting within the developer unit about the developer unit pivot axis, said pivot stack having a first stack passage therethrough;

b. means for retaining said upper end of said pivot stack in a position fixed with respect to the pivot axis;

c. means for sealing said lower end of said pivot stack to said developer unit to prevent leakage of toner therebetween;

d. a mount fixed with respect to the chassis and connected to the outlet end of the conduit;

e. means for releasably engaging said upper end of pivot stack, said engaging means being supported on said mount for limited movement perpendicular to the sliding axis, said engaging means engaging said upper end of said pivot stack when the developer unit is in the operative position;

f. a first passage coupled to said engaging means, said first passage having an inlet end communicating with the outlet end of the conduit and having an outlet end, said outlet end of said first passage being in communication with said first stack passage when the developer unit is in the operative position; and g. means for sealing said outlet end of said first passage when the developer unit is in the service position.

* * * * *

UNITED STATES PATENT AND TRADEMARK OFFICE

CERTIFICATE OF CORRECTION

PATENT NO. : 5,250,993

DATED : October 5, 1993

INVENTOR(S) : JOSEPH A. SEYFRIED, et al

It is certified that error appears in the above-indentified patent and that said Letters Patent is hereby corrected as shown below:

Column 11, line 42, Delete "fixed with respect to the chassis and ".

Column 12, line 51, Delete "fixed with respect to the chassis and".

Signed and Sealed this

Sixth Day of September, 1994

*Attest:*

Bruce Lehman

BRUCE LEHMAN

*Attesting Officer*

*Commissioner of Patents and Trademarks*